US005890473A

United States Patent [19]

Hammer et al.

[11] Patent Number: 5,890,473

[45] Date of Patent: Apr. 6, 1999

[54] IGNITION DEVICE FOR A MULTI-CYLINDER INTERNAL COMBUSTION ENGINE

[75] Inventors: Uwe Hammer, Schwieberdingen; Dieter Betz, Vaihingen; Karl-Heinz Nuebel, Simmozheim, all of Germany

[73] Assignee: Robert Bosch GmbH, Stuttgart, Germany

[21] Appl. No.: 930,660

[22] PCT Filed: Oct. 28, 1996

[86] PCT No.: PCT/DE96/02048

§ 371 Date: Apr. 6, 1998

§ 102(e) Date: Apr. 6, 1998

[87] PCT Pub. No.: WO97/29280

PCT Pub. Date: Aug. 14, 1997

[30] Foreign Application Priority Data

Feb. 6, 1996 [DE] Germany ..... 196 04 105.8

[51] Int. Cl.[6] ..... F02P 11/00

[52] U.S. Cl. ..... 123/635; 123/143 C

[58] Field of Search ..... 123/635, 634, 123/143 C; 439/128

[56] References Cited

U.S. PATENT DOCUMENTS

| | | | |
|---|---|---|---|
| 4,706,639 | 11/1987 | Boyer et al. | 123/143 C |
| 5,109,828 | 5/1992 | Tagami et al. | 123/635 |
| 5,111,790 | 5/1992 | Grandy | 123/634 |
| 5,152,274 | 10/1992 | Maekawa | 123/635 |
| 5,239,973 | 8/1993 | Murata et al. | 123/635 |
| 5,501,205 | 3/1996 | Betz et al. | 123/635 |
| 5,577,921 | 11/1996 | Philyaw et al. | 123/635 |

FOREIGN PATENT DOCUMENTS

| | | |
|---|---|---|
| 512357 | 11/1992 | European Pat. Off. . |
| 2655385 | 6/1991 | France . |

*Primary Examiner*—John T Kwon
*Attorney, Agent, or Firm*—Kenyon & Kenyon

[57] ABSTRACT

An ignition device 11 for a multi-cylinder internal combustion engine is to be designed so that it operates reliably even under conditions of vibration acceleration of the internal combustion engine. Ignition device 11 has, depending on the number of cylinders of the internal combustion engine, rod-shaped ignition coils 12. An end section 22 of each ignition coil 12 is formed by a part of a core 23 of ignition coil 12 that protrudes from a housing 20 of ignition coil 12. A damper 29 is mounted on the part of core 23. The other end section 21 of ignition coil 12 is formed by a high-voltage dome 27, which is mounted in a socket 39 made of elastic material and placed in a spark plug pit 15 of a cylinder head 13 of the internal combustion engine. Ignition device 11 is elastically held by fastening element 33 and secured at both end sections 21, 22 on cylinder head 13 of the internal combustion engine. The high voltage is transferred in an elastic manner to a corresponding spark plug 16 via a high-voltage contact element 48, designed as a spring.

6 Claims, 1 Drawing Sheet

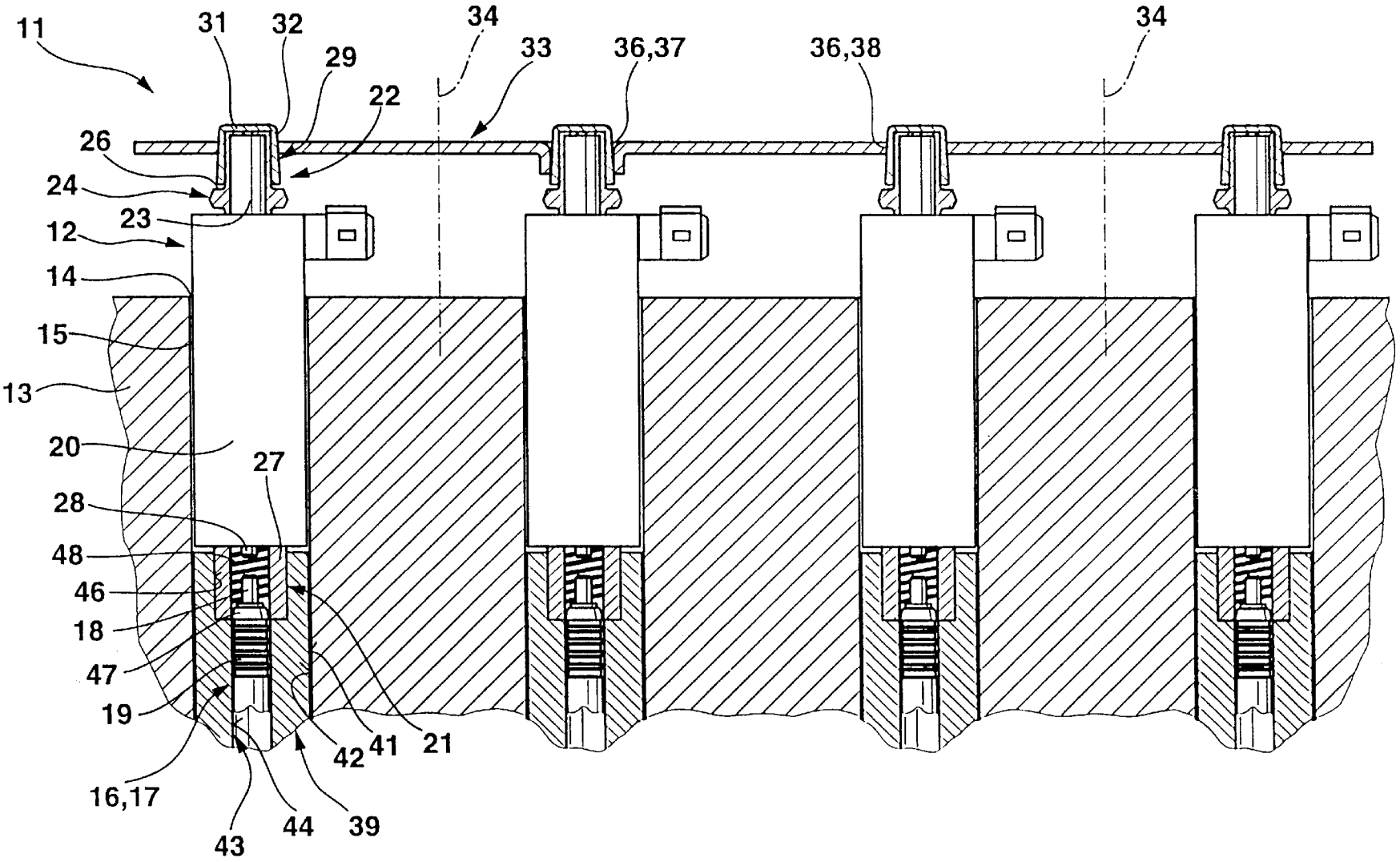
34
36,38
36,37
33
34
22
29
32
31
11
26
24
12
23
14
15
13
20
28
48
46
18
47
19
16,17
27
21
41
42
39
44
43

IGNITION DEVICE FOR A MULTI-CYLINDER INTERNAL COMBUSTION ENGINE

FIELD OF THE INVENTION

The present invention relates to an ignition device for a multi-cylinder internal combustion engine.

BACKGROUND INFORMATION

An ignition device, in which a plurality of individual ignition coils are individually mounted in a supporting unit and protrude from the supporting unit with their high-voltage domes, is described in European Patent No. 0 512 357.

A support unit assembled in this manner can be installed as a single piece on the cylinder head of an internal combustion engine, whereby all spark plugs become connected with the respective ignition coils.

However, the ignition coils are disadvantageously rigidly fastened in the supporting unit, so that they are exposed to strong vibration accelerations during operation of the internal combustion engine, which may impair the operating reliability of the ignition device.

SUMMARY OF THE INVENTION

The ignition device according to the present invention has the advantage over the background art in that the aforementioned disadvantage is eliminated to a satisfactory degree. For this purpose, an end section of each ignition coil of the ignition device is formed by a part of the ignition coil core protruding from the ignition coil housing, on which a damper is mounted. Since the other end section of each ignition coil is connected to at least one elastic body, the ignition device can be elastically fastened on a cylinder head of the internal combustion engine using a fastening element.

Vibration acceleration during the operation of the internal combustion engine is thus dampened and the operating reliability of the ignition device is maintained even under such loads.

BRIEF DESCRIPTION OF THE DRAWING

The FIGURE shows a partially sectioned side view of an ignition device according to an embodiment of the present invention.

DETAILED DESCRIPTION OF THE INVENTION

An ignition device 11 illustrated in the figure for a multi-cylinder internal combustion engine comprises, depending on the number of cylinders of the internal combustion engine, a plurality of ignition coils 12. Ignition device 11 is designed for mounting on a cylinder head 13 of the internal combustion engine. "Spark plug pits" 15 with round average cross sections are arranged in cylinder head 13, each one assigned to one cylinder and each with an inlet opening 14. A spark plug 16 is fastened in a fixed position, recessed in each spark plug pit 15 in a known manner. Spark plug 16 has a high-voltage terminal 17 inside, facing inlet opening 14; said high-voltage terminal comprises a pin-shaped electrode 18 and a basically cylindrical insulating body 19 supporting electrode 18.

Ignition coils 12 are designed as rod coils with a cylindrical housing 20 made of elastic insulating material. The diameter of housing 20 is smaller than the diameter of spark plug pit 15 to allow some play. A first end section 21 for arranging the respective spark plug 16 on high-voltage terminal 17 and a second end section 22 as an extension of a core 23, otherwise running inside housing 20 of ignition coil 12, protrude from the housing.

Core 23 is rod-shaped, it is made of a layered, magnetically conductive material, and supports, in a known manner, a concentric arrangement of a primary and a secondary coil, not illustrated here.

Core 23 has a spray coating 24 of plastic material, which envelops core 23 over large areas, but at the beginning of second end section 22, at the outlet from housing 20, it is shaped as an axially oriented shell-shaped high-voltage dome 27, in addition to a radially extending peripheral shoulder 26, as a first end section 21 in the form of an extension of core 23. Recessed from the free end of high-voltage dome 27, an axially oriented pin-shaped high-voltage connecting element 28 is arranged in said high-voltage dome.

A damper 29 in the form of a hat-shaped rubber cap is mounted on the second end section 22, with bottom 31 in contact with the face of second end section 22, and with an external surface 32 laterally in contact with the second end section 22 up to shoulder 26. External surface 32 has a conical contour that tapers toward bottom 31.

To position and mount ignition coils 12 on cylinder head 13, a single-piece, stirrup-shaped fastening element 33 is provided, designed as a stamped part, which can be screwed onto cylinder head 13 along reference lines 34 in a manner not illustrated in detail. Each fastening element 33 has a recess 36 in the form of a bore hole 37 or a passage 38 in correspondence with the mounting position of ignition coils 12 on cylinder head 13 for receiving damper 29.

At the beginning of the assembly of ignition device 11 on cylinder head 13, a socket 39 made of elastic insulating material, is inserted in each spark plug pit 15 to the longitudinal stop with the cylindridcal surface 41 of socket 39 being in play-free contact with a wall 42 of spark plug pit 15. Socket 39 has a stepped bore hole 43 with a first bore hole section 44 and a second bore hole section 46. When socket 39 is inserted, bore hole section 44, with a smaller diameter, encloses, without play, insulating body 19 of spark plug 16, which is in its final installed position, up to a centering section 47 of insulating body 19 located next to electrode 18.

Ignition coil 12 is now introduced in spark plug pit 15 with a radial play until the face of housing 20 comes into contact with the end of socket 39. In this end position of ignition coil 12, the end zone of high-voltage dome 27 encloses centering section 47 of insulating body 19 on the inside with some clearance and, on the outside, is in contact with the second bore hole section 46, with a greater diameter, of socket 39 without play or with a slight radial pressure.

In addition, in the final position of ignition coil 12, a high-voltage contact element 48, in contact with high-voltage connecting element 28, in the form of a metallic helical spring is in a non-positive contact with electrode 18 of spark plug 16, establishing the electric connection between the output of ignition coil 12 and the input of spark plug 17 in a flexible manner.

At the end of the assembly of ignition device 11, fastening element 33 is placed on ignition coils 12 so that each damper 29 is in its respective recess 36. The inside width of recess 36 is such that damper 29 can pass through it in the area of bottom 31, but then, after approximately one-third of the length of damper 29, its outer surface 32 comes into contact with the inside of recess 36, preventing further passage of damper 29.

Subsequently fastening element 33 is screwed onto cylinder head 13 along reference lines 34 in a manner that is not illustrated in detail, and thus ignition coils 12 are axially secured. Rod-shaped ignition coils 12 are secured at the end against the restoring force of dampers 29 and sockets 39, providing an elastic, vibration-dampening attachment of ignition device 11 on cylinder head 13 of the internal combustion engine. For greater operating reliability of ignition device 11, the high-voltage transfer from ignition coils 12 to spark plugs 16 is flexible.

What is claimed is:

1. An ignition device for a multi-cylinder internal combustion engine, comprising:

a plurality of ignition coils, each of the ignition coils including a core inside a cylindrical housing, a first end section, and a second end section formed with a part of the core which protrudes from the housing;

at least one damper connected to the second end section of each of the ignition coils;

a fastening element connected to the at least one damper, the fastening element holding each of the ignition coils in a corresponding at least one spark plug pit of a cylinder head;

at least one elastically deformable body coupling the first end section of at least one of the ignition coils to a high-voltage terminal of a corresponding at least one spark plug mounted in the corresponding at least one spark plug pit;

wherein each of the cores is composed of magnetically conducting material; and wherein each of the housings is composed of electrically insulating material.

2. The ignition device according to claim 1, wherein each of the ignition coils is a rod-shaped ignition coil, wherein each of the ignition coils includes a cylindrical outer shape, and wherein the first end section and the second end section are axially aligned opposite one another.

3. The ignition device according to claim 1, wherein the at least one damper includes a rubber cap mounted on the second end section, wherein the at least one damper encloses the second end section, and wherein the at least one damper includes a conical outer surface tapering toward a face of the second end section.

4. The ignition device according to claim 1, wherein the fastening element includes a single-piece, stirrup-shaped sheet metal part attached to the cylinder head of the internal combustion engine, and wherein the fastening element includes recesses in a form of one of bore holes and passages for receiving dampers.

5. The ignition device according to claim 1, wherein the at least one elastically deformable body includes a rubber socket supported in the at least one spark plug pit and an electrically conducting high-voltage contact element, and wherein the electrically conducting high-voltage contact element is in a non-positive electric contact with both an electrode forming a part of the high-voltage terminal of the at least one spark plug and with a high-voltage terminal element of at least one of the ignition coils.

6. The ignition device according to claim 5, wherein the rubber socket includes a stepped bore hole, the stepped bore hole enveloping both a high voltage dome of at least one of the ignition coils which forms the first end section and an insulating body of the at least one spark plug which forms an additional part of the high-voltage terminal.

* * * * *